US005823132A

United States Patent [19]

Donavon

[11] Patent Number: 5,823,132

[45] Date of Patent: Oct. 20, 1998

[54] FLOATING DECK

[76] Inventor: Brooks L. Donavon, 2107 Van Orman Dr., Deltona, Fla. 32725

[21] Appl. No.: 723,987

[22] Filed: Sep. 30, 1996

[51] Int. Cl.[6] ..... B63B 35/44

[52] U.S. Cl. ..... 114/266; 114/362

[58] Field of Search ..... 405/219; 114/263, 114/264, 266, 267, 219, 362

[56] References Cited

U.S. PATENT DOCUMENTS

| | | | |
|---|---|---|---|
| Re. 31,984 | 9/1985 | Sluys | 114/266 |
| 2,742,012 | 4/1956 | Bridges | 114/266 |
| 3,045,263 | 7/1962 | Blachly | 9/1 |
| 3,091,203 | 5/1963 | Usab | 114/266 |
| 3,134,113 | 5/1964 | Boyington et al. | 9/6 |
| 3,630,163 | 12/1971 | Williams | 114/61 |
| 3,659,540 | 5/1972 | Toby et al. | 114/266 |
| 3,665,885 | 5/1972 | Javes | 114/61 |
| 3,844,236 | 10/1974 | Boyajian | 114/266 |
| 3,968,532 | 7/1976 | Bailey | 9/2 |
| 4,537,144 | 8/1985 | Horton | 114/61 |
| 4,562,786 | 1/1986 | Pruonto | 114/61 |
| 4,729,335 | 3/1988 | Vidovic | 114/266 |
| 4,846,303 | 7/1989 | Cooper et al. | 114/362 |
| 4,926,776 | 5/1990 | Corbett | 114/263 |
| 5,247,899 | 9/1993 | Boesser | 114/263 |

FOREIGN PATENT DOCUMENTS

| | | | |
|---|---|---|---|
| 2362044 | 4/1978 | France | 114/264 |
| 2555541 | 5/1985 | France | 114/267 |

*Primary Examiner*—Ed L. Swinehart
*Attorney, Agent, or Firm*—Edward M. Livingston, Esq.

[57] ABSTRACT

A structural deck (1) has watertight flotation (2, 16, 18, 20) and structural resistors (8) to movement in water and wave-resistance. Wave-resistance also is resistant to movement in water. Railing sections (11) which are convertible to ladders, steps (13) and ramps (22) are provided in addition to fixed railing (10) and drop-down or removable railing as desired. Furnishing and fixtures for swimming, diving, fishing, eating, entertainment and weather protection (25, 26, 27) can be attached as desired. Powered propulsion (4, 5, 21, 23, 24) is provided for slow and convenient movement for repositioning in bodies of water. Construction can be sectional (17, 18, 20) for convenient assembly and disassembly.

24 Claims, 3 Drawing Sheets

FLOATING DECK

BACKGROUND OF THE INVENTION

This invention relates to marine docks, marine vessels and more particularly a floating deck.

Currently, most often when someone desires to install a dock or deck on a lake, as the lake bottom is disturbed during construction, building and environmental permits must be obtained. Also, such docks or decks are permanently affixed and thus, cannot be moved or transported as desired.

Furthermore, known marine deck vessels are fashioned to travel in water as efficiently as possible in proportion to area of deck space they provide per total size. Most are catamaran-based. Some are pontoon-based. None, however, are resistant to movement in water, unsinkable, stable and adaptable to a wide variety of water-deck entertainment in a manner taught by this invention.

Thus, a need exists for a water dock or deck that does not require an environmental permit for construction, which is movable and transportable and which is suitable for a variety of uses.

Examples of different but related marine deck vessels are described in the following patent documents. U.S. Pat. No. 4,926,776, issued to Corbett, described a floating dock that was positioned on pontoons and adjustable vertically for marine work. U.S. Pat. No. 4,562,786, issued to Pruonto, described a collapsible deck assembly on pontoon hulls. U.S. Pat. No. 3,968,532, issued to Bailey, taught a knock-down boat that was positional on catamaran pontoons. U.S. Pat. No. 4,537,144, issued to Horton, taught a propelled deck on catamaran hulls for fishing. U.S. Pat. No. 3,665,885, issued to Javes, taught a catamaran-supported deck with an outboard-motor on each hull. U.S. Pat. No. 3,630,163, issued to Williams, taught a catamaran with adjustable width. U.S. Pat. No. 3,045,263, issued to Blachly, described a raft structure with an inverted basin that fit over a plurality of elongated floats.

SUMMARY OF THE INVENTION

In light of need for improvement of water-entertainment decks, objects of this invention are to provide a floating deck which:

Can be positioned where desired on bodies of water for waterside uses;

Resists movement from where positioned in water;

Is unsinkable;

Resists entry of lake-sized waves;

Resists excessive tipping;

Is convenient to move slowly when desired to be repositioned in bodies of water;

Can be used as a dock in place of stationary docks that require piling support;

Does not require dock-construction or environmental permits for use as a dock on waterfronts;

Can be fitted with a wide variety of deck structure and furnishings;

Can be produced in a wide variety of sizes and shapes for different use conditions;

Has convertible boarding and railing;

Is safe from projection injuries;

Can be cleaned and services easily when desired; and

Is transportable between manufacturing and water sites.

This invention accomplishes these and other objectives with a floating deck having watertight flotation, structural resistance to movement in water and wave-resistance. The wave-resistance also is resistant to movement in water. Railing convertible to ladders, steps and ramps is provided in addition to fixed railing and removable railing as desired. Furnishing and fixtures for swimming, diving, fishing, eating, entertainment and weather protection can be attached as desired. Powered propulsion is provided for slow and convenient movement for repositioning in bodies of water. Construction can be sectional for convenient assembly and disassembly.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
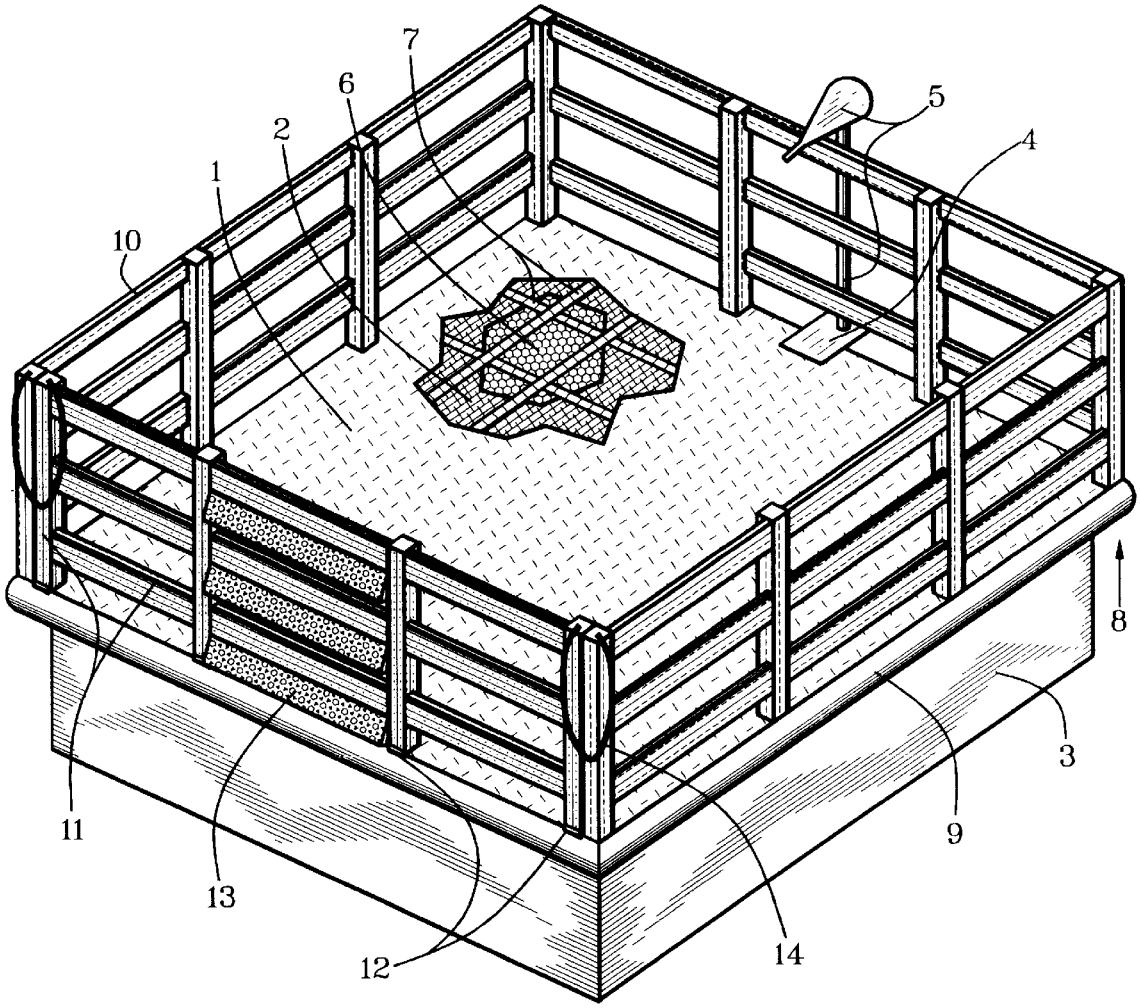
FIG. 1 is a partially cutaway perspective view of a relatively small embodiment on a full-deck float.

Reference is made first to FIG. 1 of the drawings. A deck structure 1 positioned on a watertight float 2 has sidewalls 3 extended designedly downward intermediate the deck structure 1 and water in which the floating deck is positioned. The sidewalls 3 have designedly broad and vertical surfaces in contact with water to deter movement in the water and to deter upward flow of waves onto the deck structure 1. A propulsion bracket 4 for a select propulsion means, such as a trolling motor 5, is positioned on the deck structure 1. The watertight float 2 can contain buoyant material 6, such as a plastic air-foamed substance, and can be attached to a framework 7.

Extending outwardly from top portions of the sidewalls 3 is an upward-flow inhibiter 8 that can be a horizontally outward extension of the deck structure 1 covered by a cushioned bumper 9. The upward-flow inhibiter 8 deters entry of waves onto the deck structure 1 and also deters easy movement of the floating deck through water in which it is positioned. Deterring easy movement through water prevents the floating deck from moving easily from wherever it is positioned. Very slow movement, at approximately two knots, however, can be accomplished easily with a relatively low-power propulsion means. Different from catamarans, rafts and various known marine deck vessels, this floating deck is intended to resist movement in water.

Select deck fixtures on the deck structure 1 can include a railing 10 having at least one entry. The entry can be a ladder railing 11 that is attached pivotally to the deck structure 1 by such means as ladder hinges 12. On the ladder railing 11 can be stair steps 13 for walk-up entry when the ladder railing 11 is pivoted downwardly to a slanting attitude where it is held by a restrainer such as a ladder line 14. Other types of entries also can be provided.

Figure 2:
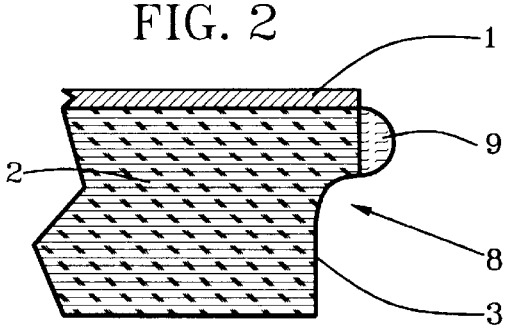
FIG. 2 is a fragmentary sectional view of a side having a wave-deflection and movement-obstruction shape with a cushioned bumper attached to the watertight float.
Figure 3:
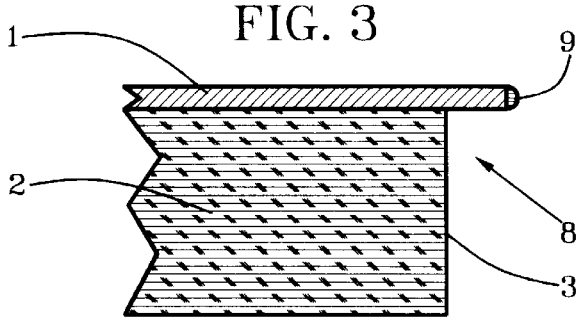
FIG. 3 is a fragmentary sectional view of a side having a wave-deflection and movement-obstruction shape formed by extension of the deck and having a cushioned bumper attached.
Figure 4:
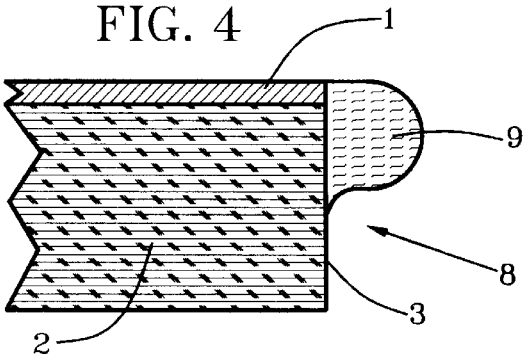
FIG. 4 is a fragmentary sectional view of a side having a wave-deflection and movement-obstruction shape formed by extending a cushioned bumper from a top edge of the floating deck.
Figure 5:
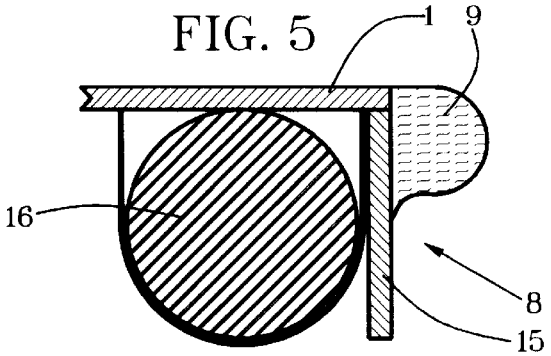
FIG. 5 is a fragmentary sectional view of a side having a wave-deflection and movement-obstruction shape formed by extending a cushioned bumper from a top of a skirt and an edge of a floating deck having a cylindrical watertight float.

FIGS. 2–5 illustrate optional forms of upward-flow inhibitors 8 in relation to sidewalls 3, deck structure 1, a cushioned bumper 9 and a watertight float 2. FIG. 2 depicts a watertight float 2 that is shaped arcuately into an upward-flow inhibiter 8 on which a cushioned bumper 9 is positioned. FIG. 3 depicts a watertight float 2 having a deck structure 1 that is extended horizontally over tops of sidewalls 3 that are vertical to form an upward-flow inhibiter 8. A cushioned bumper 9 can be positioned on outside edges of the deck structure 1 as shown. FIG. 4 depicts a cushioned bumper 9 that is sized and shaped to form an upward-flow inhibiter 8 at tops of sidewalls 3 and outside edges of the deck structure 1 that can be relatively in line. FIG. 5 depicts a deck skirt 15 that is suspended downwardly from edges of a deck structure 1, to which a float unit such as a cylindrical float 16 is attached. As for the FIG. 4 illustration, this embodiment can have a cushioned bumper 9 that is sized and shaped to form an upward-flow inhibiter 8 at tops of sidewalls 3 and outside edges of the deck structure 1 that can be relatively in line.

Figure 6:
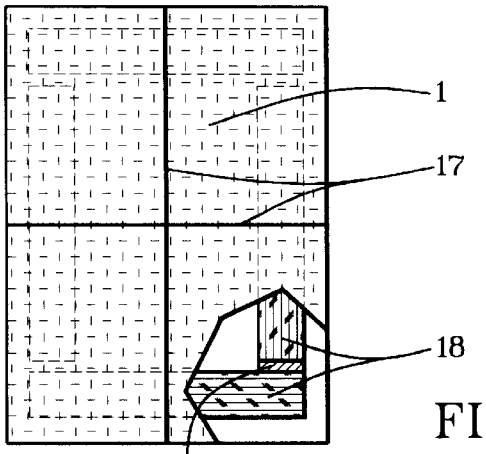
FIG. 6 is a partially cutaway top view of a deck structure in sections and resting on a peripheral watertight float.

FIG. 6 illustrates a deck structure 1 that can be sectioned for on-site fabrication at select section lines 17 and positioned on rectangular unit floats 18 that can be joined together with unit connections 19 and/or joined to the deck structure 1 for peripheral positioning as a peripheral watertight float 2. Peripheral positioning at all sides of the deck structure 1 as depicted aids flotation stability and facilitates on-site construction of relatively large floating decks.

Figure 7:
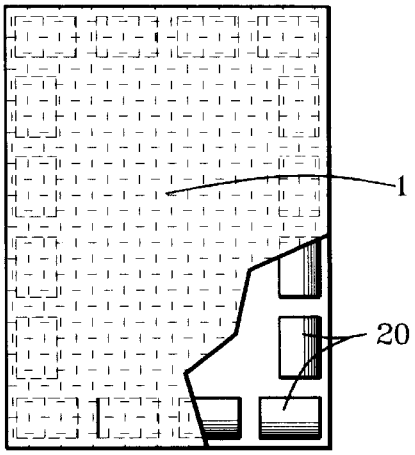
FIG. 7 is a partially cutaway top view of a deck structure resting on a peripheral watertight float comprised of a plurality of cylindrical float units.

FIG. 7 illustrates use of cylindrical unit floats 20 that are positioned peripherally under all sides of a deck structure 1. Edge structure similar to the FIG. 5 illustration is assumed for the FIG. 7 illustration. The rectangular unit floats 18 and the cylindrical unit floats 20 can be foam-filled, air-filled or foam-constructed. Cylindrical unit floats 20 can be barrels or barrel-like for low cost of production and ease of on-site fabrication. The FIG. 7 deck structure 1 can be sectioned as depicted in FIG. 6.

Figure 8:
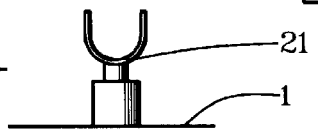
FIG. 8 is a sectional view of a bracket for supporting select manual-propulsion means.

FIG. 8 illustrates a propulsion bracket 4 for select manual-propulsion means for use on relatively small floating decks. A manual-propulsion means can be an oriental type of fish-tail oar that fits into a pivotal yoke 21. In shallow water, particularly near shores of lakes for which this invention is especially suited, the fish-tail oar can be pushed against water bottoms as practiced where this type of water propulsion originated.

Figure 9:
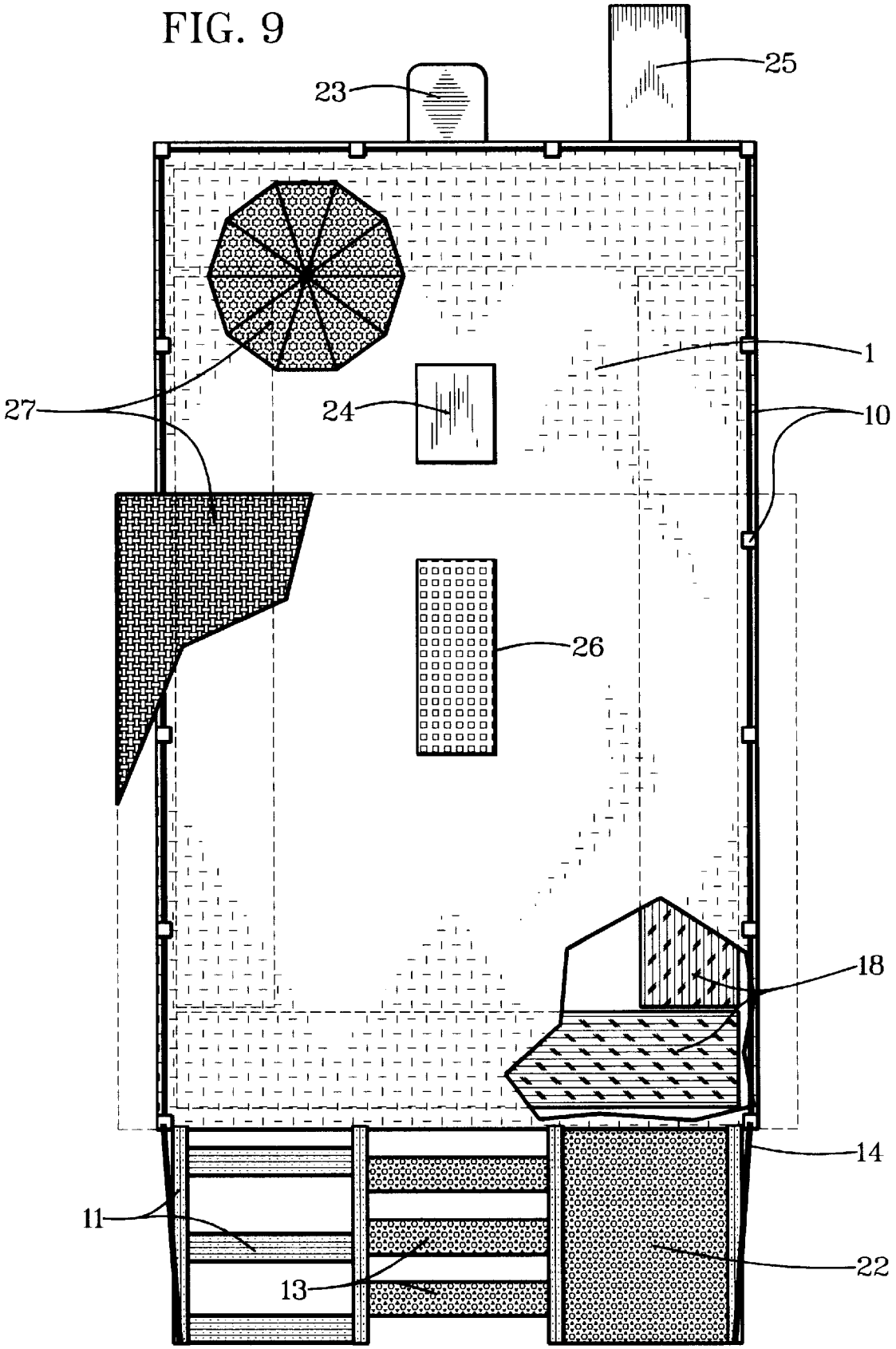
FIG. 9 is a partially cutaway top view of a larger and more comprehensive embodiment positioned on a peripheral watertight float.

FIG. 9 illustrates a relatively large and comprehensively-furnished floating deck that can have a ramp platform 22 on the ladder railing 11; optionally an outboard motor 23 or an inboard motor 24; swimming and diving equipment 25; eating, drinking and food-preparation facilities 26; convertible deck covers 27; and other desired human amenities.

A new and useful floating deck having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A floating deck comprising:

a deck structure positioned on a watertight float;

sidewalls extended designedly downward intermediate the deck structure and water in which the floating deck is positioned;

the sidewalls having designedly broad and vertical surfaces in contact with the water to deter movement in the water and to deter entry of water onto the deck structure;

select deck fixtures on the deck structure including a railing having at least one entry, a select section of the railing being a convertible ladder that is pivotal downward from the deck structure, a select portion of the convertible ladder having a ramp platform; and a propulsion bracket on the deck structure.

2. A floating deck as described in claim 1 wherein:

the watertight float contains buoyant material that will not sink when immersed in water.

3. A floating deck as described in claim 2 wherein:

the buoyant material is a plastic air-foamed substance.

4. A floating deck as described in claim 1 wherein:

the watertight float is a plurality of airtight containers.

5. A floating deck as described in claim 1 wherein:

the watertight float is positioned vertically under an outside perimeter of the deck structure and under internal portions of the deck structure selectively.

6. A floating deck as described in claim 1 wherein:

the deck structure is extended outward horizontally from tops of the sidewalls.

7. A floating deck as described in claim 6 wherein:

cushioned bumpers are positioned on outside edges of the deck structure which is extended outward horizontally from tops of the sidewalls.

8. A floating deck as described in claim 1 wherein:

cushioned bumpers are positioned on outside edges of the deck structure proximate tops of the sidewalls.

9. A floating deck as described in claim 8 wherein:

the cushioned bumpers are upward-flow inhibitors which deter upward flow of waves onto the deck structure and which deter movement of the sidewalls through water by restriction of upward flow of water from movement of the sidewalls through water.

10. A floating deck as described in claim 7 wherein:

the cushioned bumpers are upward-flow inhibitors which deter upward flow of waves onto the deck structure and which deter movement of the sidewalls through water by restriction of upward flow of water from movement of the sidewalls through water.

11. A floating deck as described in claim 6 wherein:

the deck structure extended outward horizontally is an upward-flow inhibiter which deters upward flow of waves onto the deck structure and which deters movement of the sidewalls through water by restriction of upward flow of water from movement of the sidewalls through water.

12. A floating deck as described in claim 1 wherein:

the watertight float has peripheral walls with design perpendicularity in contact with water in which the floating deck is positioned and top portions of the watertight float are extended outward horizontally as an upward-flow inhibiter which deters upward flow of waves onto the deck structure and which deters movement of the watertight float through water by restriction of upward flow of water from movement of the peripheral surfaces of the watertight float through water.

13. A floating deck as described in claim 1 wherein:

cushioned bumpers are positioned on top edges of the watertight float.

14. A floating deck as described in claim 13 wherein:

the cushioned bumpers are upward-flow inhibitors which deter upward flow of waves onto the deck structure and which deter movement of the watertight float through water by restriction of upward flow of water from movement of peripheral walls of the watertight float through water.

15. A floating deck as described in claim 1 wherein:

the sidewalls are peripheral sides of the watertight float.

16. A floating deck as described in claim 1 wherein:

select portions of the convertible ladder have step platforms.

17. A floating deck as described in claim 1 wherein:

the deck structure contains an attachment for diving equipment.

18. A floating deck as described in claim 1 wherein:

the propulsion bracket is a bracket for supporting a select outboard-propulsion motor or engine.

19. A floating deck as described in claim 1 wherein:

the propulsion bracket is a bracket for supporting select inboard-propulsion motor or engine.

20. A floating deck as described in claim 1 wherein:

the propulsion bracket is a bracket for supporting a select manual-propulsion means.

21. A floating deck as described in claim 1 wherein:

the deck structure is constructed in a plurality of sections for prefabrication and on-site assembly.

22. A floating deck as described in claim 1 wherein:

the watertight float is constructed in a plurality of sections for prefabrication and on-site assembly.

23. A floating deck as described in claim 1 wherein:

the watertight float is constructed in a plurality of sections that are attachable rigidly to the deck structure.

24. A floating deck as described in claim 1 wherein:

the watertight float is a single unit positioned under a design totality of the deck structure and attached rigidly to the deck structure.

* * * * *